United States Patent [19]

Culver

[11] 4,347,800

[45] Sep. 7, 1982

[54] RETRACTABLE TOWING PIN

[75] Inventor: Frederick H. Culver, Covington, La.

[73] Assignee: Fritz Culver, Inc., Covington, La.

[21] Appl. No.: 113,954

[22] Filed: Jan. 21, 1980

[51] Int. Cl.[3] ..... B63B 21/04

[52] U.S. Cl. ..... 114/218; 254/415

[58] Field of Search ..... 114/218, 249, 251–254; 280/405 A, 407, 425 R, 438 R, 439; 46/146; 254/395, 398, 396, 402, 405, 413, 415

[56] References Cited

U.S. PATENT DOCUMENTS

| | | | |
|---|---|---|---|
| 1,299,529 | 4/1919 | Young | 114/218 |
| 2,555,805 | 6/1951 | Miller | 114/218 |
| 2,783,025 | 2/1957 | Scheidt | 254/396 |
| 3,380,758 | 4/1968 | Granning | 280/438 R X |
| 3,588,051 | 6/1971 | Leeming | 254/395 |
| 3,691,675 | 9/1972 | Rodgers | 46/146 X |
| 3,717,273 | 2/1973 | Berends | 280/438 R |
| 3,768,175 | 10/1973 | Hill et al. | 46/146 X |
| 3,771,488 | 11/1973 | Eckle | 114/218 |
| 3,973,511 | 8/1976 | Balston | 114/218 |
| 4,154,428 | 5/1979 | Merry | 114/218 X |
| 4,195,587 | 4/1980 | Voss | 114/218 |
| 4,278,041 | 7/1981 | Williams | 114/218 X |

FOREIGN PATENT DOCUMENTS

| | | | |
|---|---|---|---|
| 635569 | 9/1936 | Fed. Rep. of Germany | 114/218 |

*Primary Examiner*—Richard L. Chiesa

*Attorney, Agent, or Firm*—LeBlanc, Nolan, Shur & Nies

[57] ABSTRACT

A retractable towing pin unit is provided for use on marine vessels as a guide for tow lines which extend overboard. The unit is designed to be installed in pairs on the deck of a marine vessel for centering the lines therebetween. The unit includes a pin mounted on a platform which is pivotable between a lower, inoperative position and an upper, operative position. An inflatable actuator device operable by pressurized air is mounted underneath the platform to raise and lower the pin between extended and retracted positions relative to the deck of the vessel. When not in use, the pin is safely retracted out of the way and flush with the deck.

4 Claims, 5 Drawing Figures

RETRACTABLE TOWING PIN

The present invention relates to a retractable towing pin for use on marine vessels and, more particularly, to a retractable towing pin assembly for use on tugboats, barges and other vessels as a guide for tow lines or other similar overboard lines. Specifically, this invention concerns a retractable towing pin assembly designed to be installed in pairs on the deck of a marine vessel for centering lines, e.g., tow lines, buoy recovery lines and anchor wires, which extend overboard or in other instances where a tow line or any similar type of wire or rope needs to be centered or guided on a vessel. The towing pin is movable between retracted and extended positions relative to the deck by an inflatable, pneumatically operated actuator unit and in its retracted position, the towing pin is flush with the deck of the vessel.

In towing operations performed by tugboats and other water vessels, it is necessary to provide a guide arrangement on the vessel for a tow line which extends overboard. It has been customary to provide one or more fixed, upstanding towing pins along the edge of the vessel to guide the tow line over the side of the vessel. Typically, towing pins are used in pairs to center the tow line therebetween and limit its side-to-side movement relative to the vessel. Similar arrangements are provided for use in the handling of buoy recovery lines and anchor wires. Such towing pin arrangements are subjected to considerable lateral forces as the tow line moves from side-to-side over the edge of the vessel. Gradually, the tow pins tend to break or become dislodged as a result of these forces. Moreover, when not in use, the tow pins constitute a hazard and present a risk of physical injury to personnel on the vessel.

Various retractable rope fastening and wire handling devices for marine vessels have been proposed in the prior art. See, for example, Young, U.S. Pat. No. 1,299,529; Miller, U.S. Pat. No. 2,555,805; Lippincott, U.S. Pat. No. 3,093,106; and Ecke, U.S. Pat. No. 3,771,488, which disclose manually operable line fastening devices which are retractable into positions flush with the deck of the vessel when not in use. Similarly, German Pat. No. 635,569, issued Sept. 19, 1936, discloses a manually operable, retractable fastener. Balston, U.S. Pat. No. 3,973,511, discloses a pivotally mounted bollard for tying and casting off a mooring line. Walker, U.S. Pat. No. 4,067,281, similarly discloses a pivotal mooring device which is operable by hydraulic cylinders.

The present invention contemplates a retractable towing pin for a marine vessel which is movable between a retracted position flush with the deck of the vessel when not in use and an extended position above the deck when actuated wherein an inflatable actuator unit is employed to move the pin between its different positions. The retractable towing pin is advantageously constructed to include a minimum number of moving parts. No hydraulic or pneumatic cylinder is required. Consequently, the retractable towing pin unit is practically maintenance free. Its construction is also considerably stronger than a towing pin which merely extends through the deck.

In accordance with the invention, a retractable towing pin assembly comprises a housing, support means mounted within the housing and movable between inoperative and operative positions, a pin mounted on the support means for movement between retracted and extended positions relative to the housing upon movement of the support means between its inoperative and operative positions, respectively, and inflatable actuator means for moving the support means between its inoperative and operative positions to move the pin between its retracted and extended positions. Preferably, the support means comprises a platform mounted for pivotal movement between the inoperative and operative positions with the pin extending upwardly from the platform. The inflatable actuator means comprises an expandable air bag coupled to the platform and operable by pressurized air for moving the platform to its operative position upon application of pressurized air to the air bag and allowing the platform to return to its inoperative position upon release of the pressurized air therefrom.

A preferred embodiment of the retractable towing pin assembly comprises a housing provided with an open top portion, a platform mounted within the housing for pivotal movement between a lower, inoperative position and upper, operative position, a pin mounted on the platform and movable between retracted and extended positions through the open top portion of the housing upon movement of the platform between its operative and inoperative positions, respectively, and inflatable actuator means mounted underneath the platform for raising and lowering the platform between its operative and inoperative positions to extend and retract the pin. Preferably, the platform is pivotally attached adjacent to the open top portion of the housing and movable from a downwardly inclined inoperative position within the housing to a horizontal operative position level with the open top portion of the housing. Cover means is provided on the platform which is adapted to close the open top portion of the housing with the platform in its operative position. Retainer means is provided for maintaining the platform level with the open top portion of the housing when the platform is raised to its operative position.

Accordingly, a primary object of the invention is to provide a retractable tow pin assembly which is less complex in structure and more easily maintained than prior art devices.

It is also an object of the invention to provide a retractable towing pin assembly constructed with a minimum number of moving parts.

Another object of the invention is to provide a retractable towing pin assembly which employs an inflatable actuator unit to control the movement of the towing pin between its extended and retracted positions and which avoids the need for a hydraulic or air cylinder.

It is another object of the invention to provide a retractable towing pin assembly for a marine vessel in which the towing pin is flush with the deck of the vessel and out of the way when retracted and not in use.

A further object of the invention is to provide a retractable towing pin assembly which exhibits considerable strength and resistance to lateral forces exerted on the towing pin.

It is a further object of the invention to provide an improved retractable towing pin assembly for use in pairs to center a towing line, wire or rope therebetween.

These and other objects will be readily apparent with reference to the following drawings and description wherein.

Figure 1:
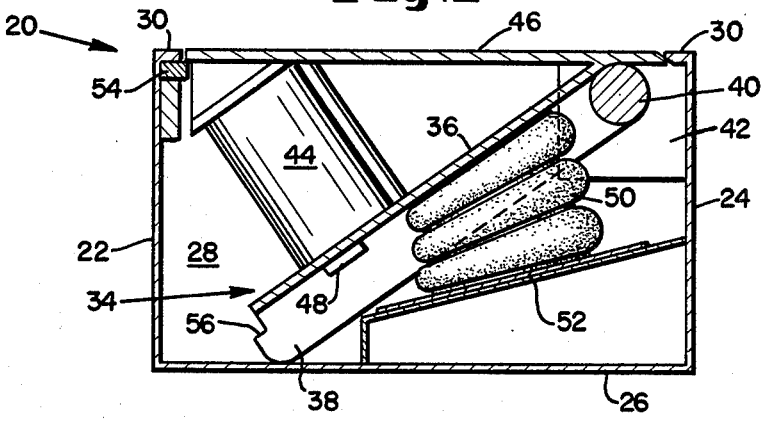
FIG. 1 is a side view, partially in section, of a retractable towing pin assembly embodying the principles of the invention.
Figure 2:
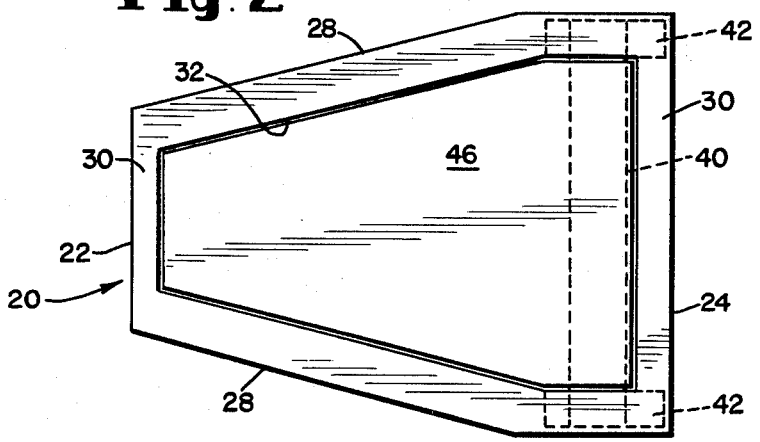
FIG. 2 is a top view of the towing pin assembly of FIG. 1.

Referring to FIG. 1, a retractable towing pin assembly, generally 20, includes a housing which comprises an upstanding front wall 22, an upstanding rear wall 24, a flat bottom wall 26 and a pair of side walls 28. As shown in FIG. 2, side walls 28 are each oriented vertically and inclined inwardly from the rear to the front of the housing. A flat, upper wall 30 extends about the periphery of the housing and defines an open portion 32 at the top of the housing.

Figure 3:
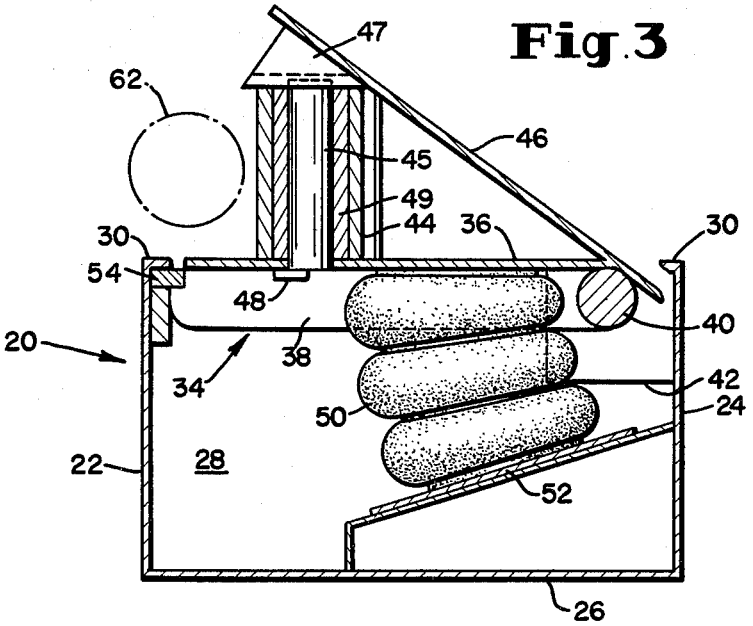
FIG. 3 is a side view, partially in section, showing the towing pin assembly activated to raise its towing pin to its operative position.

A platform, generally 34, which includes a flat support plate 36 is mounted for pivotal movement within the housing between an inoperative position (FIG. 1) and an operative position (FIG. 3). Platform 34 includes a pair of side flanges 38 (one shown) which depend from opposite longitudinal edges of plate 36. A shaft 40 is provided at the rear end of platform 34 which extends outwardly through side flanges 38 into a set of bushings 42 mounted on side walls 28 of the housing adjacent to its open top portion to allow the platform to pivot relative to the housing. Preferably, shaft 40 is made of stainless steel and bushings 42 are made of bronze. The housing and platform 34 are constructed of steel.

A roller 44 extends perpendicularly upward from support plate 36 at a position toward the front of platform 34. Roller 44 is cylindrical in shape and is rotatably mounted on plate 36. As shown in FIG. 3 roller 44 is mounted on a pin 45 which in turn is removably mounted on plate 36. The roller is movable between a retracted position (FIG. 1) with platform 34 in a downwardly inclined inoperative position and an extended position (FIG. 3) with the platform in a horizontal operative position level with the open top portion of the housing.

Preferably, a cover element 46, which closely conforms in shape to open top portion 32 of the housing, is inclined upwardly from the rear edge of plate 36 and is an integral part of the platform 34. As shown in FIGS. 1 and 2, with roller 44 retracted into the housing, cover element 46 closes the open top portion of the housing to preclude entry of debris.

Cover 46 includes an extension 47. Roller 44 then extends between plate 36 and extension 47. Pin 45, preferably of stainless steel is affixed to plate 36 by mounting plate 48. Appropriate, preferably bronze, bushings 49 surround pin 45, and preferably grease fittings and grooves (not shown) are provided. Plate 48 may be secured to plate 36 by bolts (not shown).

An inflatable actuator unit 50 (FIGS. 1 and 3) is mounted underneath platform 34 for raising and lowering the platform between its operative and inoperative positions to extend and retract roller 44 through the open top portion of the housing. Preferably, inflatable actuator unit 50 comprises an expandable air bag device of bellows-like construction which is operable by pressurized air. For example, a device known as the "Firestone Airstroke", model no. 39, manufactured by Firestone Tire and Rubber Company may be used. Preferably, the top of air bag 50 is secured to the underside of plate 36 at a position toward the rear of platform 34. The bottom of air bag 50 is mounted on an inclined support surface 52 located at the rear of the housing beneath platform 34.

Preferably, actuator unit 50 is operated by the existing air pressure system of the vessel on which it is installed. A single pilot operated air valve (not shown) is located near each unit. This valve may be activated remotely from a control console or from any other desired location. A retainer element 54 (FIG. 1) extends across the front of the housing underneath top wall 30 which cooperates with a set of notches or indentations 56 (one shown) provided in side flanges 38 to limit the upward movement of platform 34.

As shown in FIG. 1, roller 44 is normally located in a retracted position in the housing with actuator unit 50 collapsed. When it is desired to raise roller 44 to its extended position (FIG. 3), pressurized air is supplied to actuator unit 50 from a source (not shown) to expand the actuator unit and raise the platform 34 to its operative position level with the open portion of the housing. As a result, pin 44 is moved upwardly through the open top portion of the housing to its extended position. As long as pressurized air is supplied to actuator unit 50, side flanges 38 of platform 34 are held in engagement with retainer element 54 to maintain the platform in its operative position. Plate 36 serves to block the entry of debris into the housing with platform 34 raised to its horizontal position. When it is desired to retract roller 44, the pressurized air is released from actuator unit 50 which collapses and allows platform 34 to pivot downwardly under its own weight. As a result, roller 44 returns to its retracted position (FIG. 1) with cover element 46 flush with the open top portion of the housing. Thus, roller 44 is safely retracted into its housing when not in use, while cover element 46 prevents the entry of debris into the housing. There are effectively no openings in the housing when roller 44 is either extended or retracted.

Figure 4:
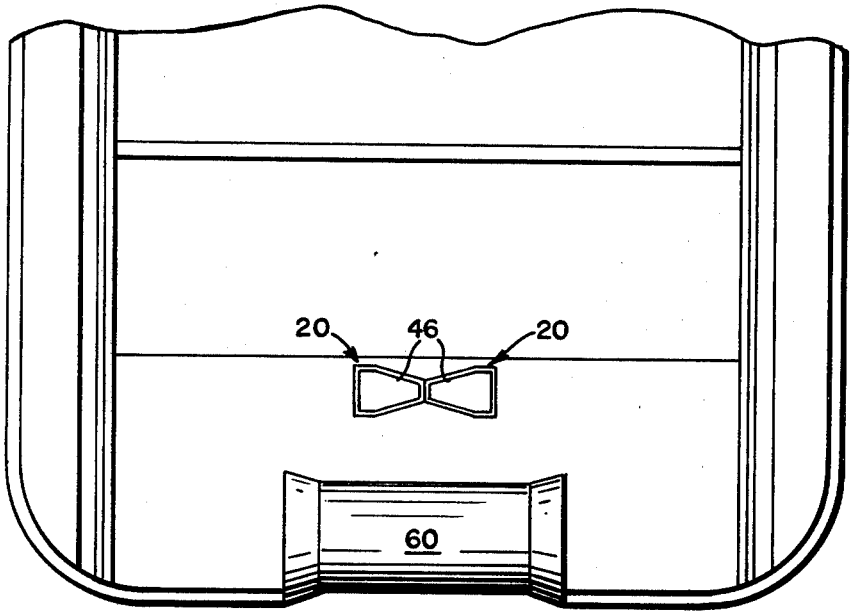
FIG. 4 is a plan view of a portion of a marine vessel illustrating a pair of the retractable towing pin assemblies mounted side-by-side.
Figure 5:
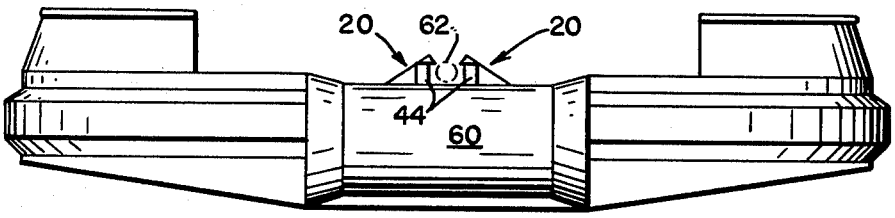
FIG. 5 is an elevation view illustrating the pair of towing pin assemblies activated to center a line therebetween.

As shown in FIGS. 4 and 5, a pair of retractable towing pin units 20 may be installed in face-to-face orientation on the deck or fan tail of a marine vessel, e.g., at the stern of a tugboat, adjacent to a guide section 60 designed to allow a towing line 62 to pass overboard. With the towing pins retracted (FIG. 4) cover elements 46 are flush with the deck of the vessel. With the towing pin units actuated (FIG. 5), rollers 44 are extended upwardly relative to the deck of the vessel to center line 62 therebetween. Preferably, a pneumatic control arrangement is provided to allow each towing pin unit to be operable independently so that line 62 can be caught between the pins by initially raising one unit and subsequently raising the other.

Referring to FIG. 3, the location of roller 44 between plate 36 and cover element 46 provides a rigid construction which enhances the strength of the device to resist the lateral forces exerted as line 62 shifts from side-to-side. This construction is able to withstand considerably larger lateral forces than the prior art designs wherein the pin merely projects upward from the deck without additional lateral reinforcement.

The specific embodiment shown in FIGS. 1–3 illustrates a construction particularly suitable for use with an 8-inch diameter roller. Preferably, the unit is designed to withstand the breaking strength of a $1\frac{1}{4}$ inch wire rope. It is contemplated that substantially the same design can be used on large vessels which require 8-inch 12-inch or larger roller pins and small vessels which require 6-inch roller pins. Moreover, it is contemplated that a similar design may be employed on small tugboats where both roller pins are mounted on the same platform and move simultaneously when the unit is activated.

In conclusion, the present invention provides a retractable towing pin unit which is conveniently operable by pressurized air to raise and lower the towing pin between its extended and retracted positions. The towing pin unit is advantageously designed to be flush with the deck of the vessel when not in use. Its construction requires only a minimum number of moving parts so that the unit is practically maintenance free. The towing pin unit is characterized by considerable strength in its resistance to lateral forces.

While a specific embodiment of the invention has been shown and described in detail, it will be understood that the invention may be modified without departing from the spirit of the inventive principles set forth in the appended claims.

I claim:

1. A retractable towing pin assembly adapted to be mounted in pairs on the deck of a marine vessel to guide a tow line therefor comprising:

a housing having an open top portion adapted to be mounted on the deck of said vessel with the top portion disposed in the horizontal plane containing the deck surface;

a shaft member pivotally mounted within and extending across said housing adjacent the open top portion and adjacent a side thereof;

a platform disposed within said housing and mounted adjacent an edge thereof on said shaft, said platform being movable between a lower, inclined position within said housing and an upper, operative position across the open top portion of said housing so that said platform in the upper position is contained in the horizontal plane containing the deck surface;

a cover plate carried by said platform at an edge thereof adjacent said shaft and extending outwardly therefrom, said cover plate being movable with said platform between a lower position wherein said plate closes the open top portion of said housing and is contained in the horizontal plane containing the deck surface and an upper position wherein said plate extends upwardly from said shaft at an acute angle to the horizontal plane;

a roller pin extending between said platform and cover plate and rotatably mounted thereto, said pin being mounted distally to the portions of said platform and plate disposed adjacent said shaft whereby when said platform and cover plate are in the lower position and pin will be contained within said housing, and when said platform and plate are in the upper position said pin will extend upwardly through the deck surface perpendicular to the horizontal plane;

inflatable actuator means mounted underneath said platform for raising and lowering said platform between its upper and lower positions to extend and retract said pin.

2. The retractable towing pin assembly of claim 1, wherein said inflatable actuator means comprises:

an expandable air bag operable by pressurized air for raising said platform to its operative position upon application of pressurized air to said air bag and allowing said platform to return to its inoperative position upon release of the pressurized air therefrom.

3. The retractable towing pin assembly of claim 2, which includes:

an inclined support surface located within said housing beneath said platform with said expandable air bag mounted thereon and attached to said platform.

4. The retractable towing pin assembly of claim 1, which includes:

retainer means for maintaining said platform level with said open top portion of said housing when said platform is raised to its operative position.

* * * * *